US007588084B2

(12) United States Patent
Hallundbæk

(10) Patent No.: US 7,588,084 B2
(45) Date of Patent: Sep. 15, 2009

(54) METHOD FOR RELEASING CABLES FROM AN ATTACHED WELL TOOL AND APPARATUS FOR EXERCISING THE METHOD

(75) Inventor: Jørgen Hallundbæk, Græsted (DK)

(73) Assignee: Welltec A/S, Allerød (DK)

( * ) Notice: Subject to any disclaimer, the term of this patent is extended or adjusted under 35 U.S.C. 154(b) by 49 days.

(21) Appl. No.: 10/532,215

(22) PCT Filed: Oct. 24, 2002

(86) PCT No.: PCT/DK02/00708

§ 371 (c)(1),
(2), (4) Date: Apr. 22, 2005

(87) PCT Pub. No.: WO2004/038171

PCT Pub. Date: May 6, 2004

(65) Prior Publication Data

US 2006/0011338 A1 Jan. 19, 2006

(51) Int. Cl.
*E21B 29/04* (2006.01)

(52) U.S. Cl. ..... 166/297; 166/54.5

(58) Field of Classification Search ..... 166/54.5–54.6, 166/55, 297

See application file for complete search history.

(56) References Cited

U.S. PATENT DOCUMENTS

| | | | | |
|---|---|---|---|---|
| 1,764,222 | A | 6/1930 | Morrison et al. | |
| 3,073,388 | A | 1/1963 | Chenault | |
| 4,572,288 | A | 2/1986 | Kinley | |
| 5,369,579 | A * | 11/1994 | Anderson | 702/11 |
| 5,513,570 | A | 5/1996 | Mulcahy | |

* cited by examiner

*Primary Examiner*—Shane Bomar
(74) *Attorney, Agent, or Firm*—The Nath Law Group; Jerald L. Meyer; Stanley N. Protigal

(57) ABSTRACT

In a method for releasing cables (2) from an attached well tool, where the cutting and the time for cutting can be decided from the surface above the well, and where a cable cutter (6) is arranged between the main part of a cable and a well tool, the cable cutter being controlled by an electronic timer, it is suggested that at least three parameters are used for controlling the cutter, e.g. a pulling force exerted by the cable on the well tool, the pressure in the well location, and time.

13 Claims, 1 Drawing Sheet

METHOD FOR RELEASING CABLES FROM AN ATTACHED WELL TOOL AND APPARATUS FOR EXERCISING THE METHOD

TECHNICAL FIELD

The present invention relates to a method for releasing cables from an attached well tool, where a cable cutter is arranged between the main part of a cable and a well tool, said cable cutter being controlled by a timer. The invention relates also to an apparatus for exercising the method.

PRIOR ART TECHNIQUE

A well bore apparatus being adapted for being releasably coupled to suspension cables is disclosed in the U.S. Pat. No. 4,237,972 in the name of C. P. Lanmon. In this prior art the inventor explains the idea of cutting the cable when the tool has fastened in the well. The basic idea is to avoid a long piece of a cable being left and destroyed between the tool and the fishing tool. Therefore, it is necessary to cut the cable close to the tool, and the cutting device is in this prior art controlled by a time delaying retaining means for preventing the actuation of the cutter, said retaining means having a chemically-corrodible element within a chamber, where a corrosive chemical can act upon the chemically-corrodible element. It is even suggested, that the chemically-corrodible element is a metal and the corrosive chemical is either an acid or a caustic. The corrosive element when released by the chemical degradation fires an explosive driving the cutting blade. To activate the cutting means, before the apparatus is lowered into a well bore a corrosive chemical is released in the apparatus for causing the failure of a restraining means only after the elapse of a predetermined time interval that is ordinarily more than sufficient for carrying out the intended operation of the apparatus. This has, however, the drawback, that the apparatus is time sensitive in relation to delays in the well operation, and on the other hand, that much time will be spent waiting, when the apparatus has stuck in the well bore.

In U.S. Pat. No. 3,073,388 another actuating means is used for the cutter. This actuating means is driven by explosives disposed in a casing means and controlled by firing means and a timing mechanism operatively connected to the firing means. The timing means are preset before being sent down the well and are initiated by positioning of the casing means at a remotely inaccessible location in the well bore. This timing means is not initiated until the positioning and much time will, also in this case, be spent waiting for the firing of the explosives. A quick release through an early cut is thus excluded. On the other hand, if, for some reason, the tool is released again, there is no way to stop the timing means and the cable will thus unavoidably be cut after the lapse of the preset time.

A normal procedure for using tools in a well bore is to send down the tool suspended in a cable. The cable is capable to carry a certain load before being destructed by the tensile stress. The tool has a mass far below the limiting tensile stress of the cable. If the tool one way another is stuck in the well bore, it is important to release the tool and pull up the cable, as exerting further tensile stress will pass the yield point of the cable material thereby permanently reducing the cross section of the cable and its possible ability to carry large electrical currents.

In cases, where the cable is also an electric wire, the electric current is depending on the tensile stress as the tensile stress reduces the cross section of the wire or the single strands and is thereby increasing the energy loss through the cable. Thus, if the cable is stretched too much, it will introduce a large specific resistance or short-circuit the different cords.

SUMMARY OF THE INVENTION

Therefore, it is a primary object of the present invention to provide a method for the cutting of the cable, where the cutting and the time for cutting can be decided from the surface above the well. To this end, the inventor has suggested that at least three parameters are used for controlling the cutter, e.g. a pulling force exerted by the cable on the well tool, the pressure in the well location, and time, where the timer is working electronically. The term "cutting" is to be interpreted in a broad sense to include any intended disconnection between the cable and the well tool, except rupture. Preferably, the temperature can also be used as a controlling parameter. The electronic timer is controlling a cutter of any appropriate type being driven by explosives or any other means. With such control of the reset of the timer the cutting can only be performed, when the cable for some time is without any current and the conditions given by the surroundings are according to the set values of the pressure, the force, or temperature, respectively. Further, by being able to reset the timing device by changing the current through the cable, the cutting can be avoided at any time before the cutting is performed.

In a preferred embodiment the timer is reset from currents in the cable through the use of an interface pick-up. Thereby, a steady detection of the currents in the cable will be possible for both large currents, i.e. measured in A or kA, or smaller currents as measured in mA.

If the cable incidentally has been destructed by increasing the tensile stress beyond the rupture limit, no current can be guided through the cable. The location of such rupture is normally closer to the surface than to the tool, as the upper part of the cable also is carrying the load of the lower part of the cable. The cutting will therefore take place after the actual preset delay. This is just a security measure, so that the cable sooner or later will be cut. In order to avoid such destruction the inventor has suggested that the pulling force exerted by the cable on the well tool is limited by a mechanical unit. It is further suggested that the activation of the limitation unit can be used for triggering the timer.

Sometimes, the delay will be too long, if the tool must be retrieved in a short time. To this end, the electronic timer—in an advantageous embodiment—can be controlled by pulses smaller than the reset pulses, thereby making it possible to the operative crew to remotely control the preset timer delay and the triggering of the cutter. In an advantageous embodiment a capacitor can be arranged between the cable and ground so that small pulses or their flanks can be directed to the timer, without seriously influencing the circuits for the larger working currents..

To exercise the invention it is suggested to use an electronic timer comprises a receiver for receiving reset signals generated by the currents in the cable, an auxiliary inlets for signals from sensors for physical parameters, and an outlet for the control of a cutter control. The physical parameters could be the pressure, temperature, or tensile stress. When these parameters exceed a preset value or leave a predetermined range, a signal is given to the timer, which—after the preset timer period—fires the cutter control and thereby disconnects the cable from the tool. The cutter control can comprise explosives or other cutting effective arrangements to secure the cutting of the cable, when needed. Such cutting effective arrangements could be springs working directly with knives, scissors or shears.

More embodiments of the subject matter invention are disclosed in the following detailed description of the invention, where an explanation is given using an example of the invention.

BRIEF DESCRIPTION OF THE DRAWING

The invention is described more clearly in a preferred embodiment shown in the drawing showing an example of a diagram of a circuit for cutting the cable.

DETAILED DESCRIPTION OF THE INVENTION

Figure 1:
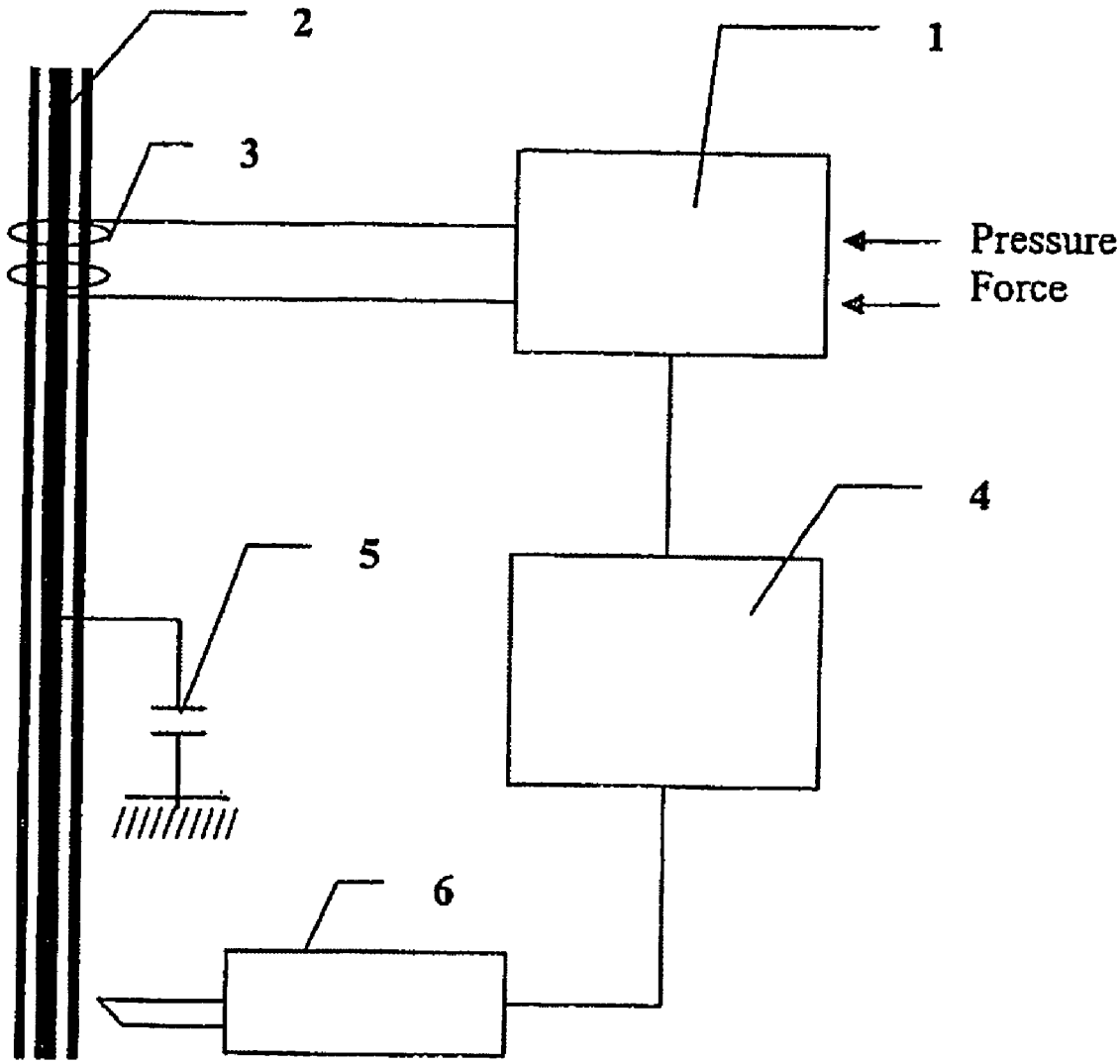

In the drawing an electronic timer device 1 is in connection with the cable 2 through a pick-up 3. Under influence from not directly shown sensors information about the pressure and the force exerted on the cable is directed to the timing device 1, which—provided the pressure and the force are according to the set values—after a period with no currents in the cable will activate the explosives control 4. This can take place at any time after the tool has stuck in the well Even if the force exerted on the cable has exceeded the limit, so that the cable has been destructed, it might still be possible to guide pulses down to the control circuit for the electronic timer. This is caused by the capacitor 5 arranged between the cable 2 and ground so that small pulses and their flanks can be directed to the electronic timer, without resetting the electronic timer circuit. For influencing the reset of the electronic timer, larger working currents are needed.

When the right conditions for firing the explosives are present, i.e. the tensile stress is above a certain limit, the pressure is likewise above the preset limit, the temperature might be above the preset limit, and the timer has been allowed to count down, the explosives control 4 will fire and activate the cutter 6, which thereby will cut the cable close to the attached well tool so as to leave as little cable as possible with the attached well tool. This measure should secure a safe fishing of the tool, as earlier such left-over of the cable could both be a waste of the cable and impede the fishing of the tool.

The invention claimed is:

1. Method for releasing cables (2) from an attached well tool, wherein a cable cutter (6) is arranged between the main part of a cable and a well tool, said cable cutter being controlled by an electronic timer, the method comprising:

using at least three parameters for controlling the cutter: a pulling force exerted by the cable on the well tool, the pressure in the well location, and time; and resetting the timer from currents in the cable (2) through the use of an interface pick-up (3).

2. Method according to claim 1, the method further comprising:

using temperature as a controlling parameter.

3. Method according to claim 1, wherein the timer (1) is also responsive to pulses of currents, the method further comprising:

making it possible for an operative crew to remotely control preset parameter values of force, pressure, temperature, or timer delay and thus a triggering of the cutter (6).

4. Method according to claim 3, the method further comprising:

controlling the timer by pulses smaller than reset pulses, wherein the pulses are given by the operative crew from the surface to remotely control the preset parameter value of timer delay and the triggering of the cutter.

5. Method according to claim 4, characterised in that the preset values for the pressure tensile stress or temperature can be changed from the operative crew.

6. Method according to claim 4, characterised in that a capacitor is arranged between the cable and ground.

7. Apparatus for releasing cables (2) from an attached well tool, wherein a cable cutter (6) is arranged between a main part of a cable and a well tool, the apparatus comprising:

an electronic timer that controls the cable cutter, the electronic timer comprising a receiver (1) for receiving reset signals generated by currents in the cable (2), auxiliary inlets for signals from sensors for physical parameters, an outlet for control of a cutter control (4), and a pick-up (3), the electronic timer in connection with the cable through the pick-up, wherein the pick-up generates reset signals by a steady detection of the currents in the cable, to which the tool is attached.

8. Apparatus according to claim 7, characterised in that the receiver (1) further has at least one circuit controlled by small pulses from the cable (2), which is connected to ground through a capacitor (5).

9. Apparatus according to claim 8, characterised in that a pulse generator on the surface is connected to the cable (2).

10. Apparatus according to claim 7, characterised in that the cutter control (4) is connected to the cable cutter (6).

11. Apparatus for releasing cables (2) from an attached well tool, wherein a cable cutter (6) is arranged between a main part of a cable and a well tool, the apparatus comprising:

an electronic timer that controls the cable cutter, the electronic timer comprising a receiver (1) for receiving reset signals generated by currents in the cable (2), auxiliary inlets for signals from sensors for physical parameters, an outlet for control of a cutter control (4), and a pick-up (3) which generates reset signals; and the receiver having at least one circuit controlled by small pulses from the cable (2), which is connected to ground through a capacitor (5).

12. Apparatus according to claim 11, characterised in that a pulse generator on the surface is connected to the cable (2).

13. Apparatus according to claim 11, characterised in that the cutter control (4) is connected to the cable cutter (6).

* * * * *